US011852998B2

(12) United States Patent
Kyotani

(10) Patent No.: US 11,852,998 B2
(45) **Date of Patent: *Dec. 26, 2023**

(54) IMAGE FORMING APPARATUS CAPABLE OF DISPLAYING ON DISPLAY ERROR RELATING TO DRUM CARTRIDGE IN PREFERENCE TO ERROR RELATING TO TONER CARTRIDGE

(71) Applicant: BROTHER KOGYO KABUSHIKI KAISHA, Nagoya (JP)

(72) Inventor: Tadao Kyotani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/167,240

(22) Filed: Feb. 10, 2023

(65) Prior Publication Data

US 2023/0185225 A1 Jun. 15, 2023

Related U.S. Application Data

(63) Continuation of application No. 17/480,406, filed on Sep. 21, 2021, now Pat. No. 11,579,554, which is a (Continued)

(30) Foreign Application Priority Data

Mar. 28, 2019 (JP) ..... 2019-063060

(51) Int. Cl.
*G03G 15/00* (2006.01)

(52) U.S. Cl.
CPC ..... *G03G 15/55* (2013.01)

(58) Field of Classification Search
CPC .. G03G 15/5016; G03G 15/502; G03G 15/55; G03G 15/553; G03G 15/556
See application file for complete search history.

(56) References Cited

U.S. PATENT DOCUMENTS 11,579,554 B2 * 2/2023 Kyotani ..... G03G 15/55
2005/0078165 A1 4/2005 Harada et al.
(Continued)

FOREIGN PATENT DOCUMENTS

JP 2001-109337 A 4/2001
JP 2008-281802 A 11/2008
(Continued)

OTHER PUBLICATIONS

International Search Report and Written Opinion issued in corresponding International Patent Application No. PCT/JP2019/042790, dated Jan. 7, 2020.
(Continued)

*Primary Examiner* — Carla J Therrien
(74) *Attorney, Agent, or Firm* — Merchant & Gould P.C.

(57) ABSTRACT

An image forming apparatus includes: a main casing; a drum cartridge; a toner cartridge; a display; and a controller. The drum cartridge is attachable to and detachable from the main casing. The drum cartridge includes a photosensitive drum and a drum memory. The toner cartridge is attachable to and detachable from the drum cartridge. The toner cartridge includes a toner memory. The controller is configured to: determine whether an error occurs in the drum cartridge through a communication with the drum memory; determine whether an error occurs in the toner cartridge through a communication with the toner memory; and when determining that an error occurs in the drum cartridge and determining that an error occurs in the toner cartridge, display on the display an error relating to the drum cartridge in preference to displaying on the display an error relating to the toner cartridge.

11 Claims, 8 Drawing Sheets

Related U.S. Application Data continuation of application No. PCT/JP2019/042790, filed on Oct. 31, 2019.

(56) References Cited

U.S. PATENT DOCUMENTS

| | | | | |
|---|---|---|---|---|
| 2005/0254840 | A1* | 11/2005 | Saisu | G03G 15/55 399/24 |
| 2008/0198028 | A1 | 8/2008 | Watanabe | |
| 2009/0269086 | A1 | 10/2009 | Mikuni | |
| 2010/0070794 | A1 | 3/2010 | Park | |
| 2010/0265538 | A1 | 10/2010 | Kotake | |
| 2011/0279844 | A1 | 11/2011 | Urasawa | |
| 2012/0069382 | A1 | 3/2012 | Osada | |
| 2013/0108282 | A1 | 5/2013 | Sonoda et al. | |
| 2016/0349699 | A1 | 12/2016 | Miyamoto et al. | |
| 2019/0196394 | A1 | 6/2019 | Yabuki et al. | |
| 2020/0159158 | A1* | 5/2020 | Miyake | B41J 3/46 |

FOREIGN PATENT DOCUMENTS

| | | | |
|---|---|---|---|
| JP | 2009-265401 | A | 11/2009 |
| JP | 2013-97069 | A | 5/2013 |
| JP | 2014-81602 | A | 5/2014 |
| JP | 2016-162094 | A | 9/2016 |
| JP | 2016-224221 | A | 12/2016 |

OTHER PUBLICATIONS

International Preliminary Report on Patentability issued in corresponding International Patent Application No. PCT/JP2019/042790, dated Sep. 28, 2021, 9 pages.

Office Action (Notice of Reasons for Refusal) issued in corresponding Japanese Patent Application No. 2019-063060, dated Nov. 1, 2022.

* cited by examiner

FIG. 3

| | | TONER MEMORY | | | |
|---|---|---|---|---|---|
| | | COMMUNICATION ERROR | AUTHENTICATION ERROR | DATA ERROR | NO ERROR |
| DRUM MEMORY | COMMUNICATION ERROR | NO DRUM (NO TONER) | DRUM SUBSTRATE ABNORMAL (CANNOT DETECT TONER) | DRUM SUBSTRATE ABNORMAL (TONER ERROR) | DRUM SUBSTRATE ABNORMAL |
| | AUTHENTICATION ERROR | CANNOT DETECT DRUM (NO TONER) | CANNOT DETECT DRUM (CANNOT DETECT TONER) | CANNOT DETECT DRUM (TONER ERROR) | CANNOT DETECT DRUM |
| | DATA ERROR | DRUM ERROR (NO TONER) | DRUM ERROR (CANNOT DETECT TONER) | DRUM ERROR (TONER ERROR) | DRUM ERROR |
| | NO ERROR | NO TONER | CANNOT DETECT TONER | TONER ERROR | (NO ERROR) |

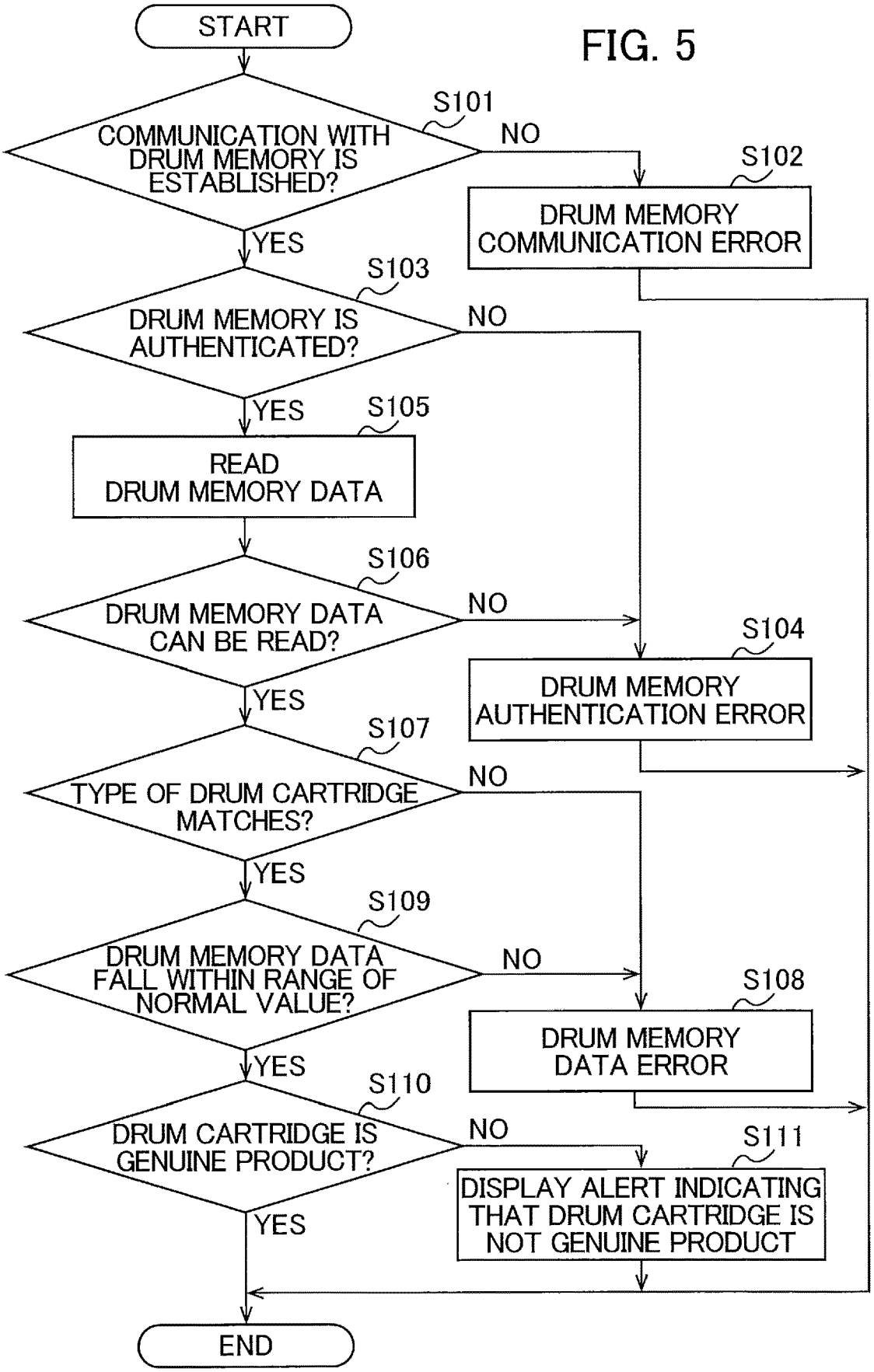
START
FIG. 5
S101
COMMUNICATION WITH DRUM MEMORY IS ESTABLISHED?
NO
S102
DRUM MEMORY COMMUNICATION ERROR
YES
S103
DRUM MEMORY IS AUTHENTICATED?
NO
YES
S105
READ DRUM MEMORY DATA
S106
DRUM MEMORY DATA CAN BE READ?
NO
S104
DRUM MEMORY AUTHENTICATION ERROR
YES
S107
TYPE OF DRUM CARTRIDGE MATCHES?
NO
YES
S109
DRUM MEMORY DATA FALL WITHIN RANGE OF NORMAL VALUE?
NO
S108
DRUM MEMORY DATA ERROR
YES
S110
DRUM CARTRIDGE IS GENUINE PRODUCT?
NO
S111
DISPLAY ALERT INDICATING THAT DRUM CARTRIDGE IS NOT GENUINE PRODUCT
YES
END

IMAGE FORMING APPARATUS CAPABLE OF DISPLAYING ON DISPLAY ERROR RELATING TO DRUM CARTRIDGE IN PREFERENCE TO ERROR RELATING TO TONER CARTRIDGE

REFERENCE TO RELATED APPLICATIONS

This application is a continuation of U.S. patent application Ser. No. 17/480,406 now U.S. Pat. No. 11,579,554, filed Sep. 21, 2021, which is a by-pass continuation application of International Application No. PCT/JP2019/042790 filed Oct. 31, 2019 claiming priority from Japanese Patent Application No. 2019-063060 filed Mar. 28, 2019. The entire contents of the above-mentioned applications are incorporated herein by reference.

BACKGROUND ART

Technical Field

The present disclosure relates to an image forming apparatus to which a drum cartridge and a toner cartridge are attachable.

Background

Conventionally, prior art discloses an image forming apparatus having a configuration in which a toner cartridge is attached to a main body of the image forming apparatus in a state where the toner cartridge is assembled to a drum cartridge.

DESCRIPTION

Summary

In an attachment of the drum cartridge and the toner cartridge, there may occur different kinds of errors depending on conditions of the drum cartridge and the toner cartridge. However, there is a problem in the image forming apparatus described in the prior art that a necessary error related to the attachment of the drum cartridge and the toner cartridge cannot be displayed in preference to displaying other errors.

In view of the foregoing, it is an object of the present disclosure to provide an image forming apparatus in which an error related to the drum cartridge can be displayed in preference to an error related to the toner cartridge.

In order to attain the above and other objects, according to one aspect, the present disclosure provides an image forming apparatus including: a main casing; a drum cartridge; a toner cartridge; a display; and a controller. The drum cartridge is attachable to and detachable from the main casing. The drum cartridge includes a photosensitive drum and a drum memory. The toner cartridge is attachable to and detachable from the drum cartridge. The toner cartridge includes a toner memory. The controller is configured to: determine whether an error occurs in the drum cartridge through a communication with the drum memory; determine whether an error occurs in the toner cartridge through a communication with the toner memory; and when determining that an error occurs in the drum cartridge and determining that an error occurs in the toner cartridge, display on the display an error relating to the drum cartridge in preference to displaying on the display an error relating to the toner cartridge.

BRIEF DESCRIPTION OF THE DRAWINGS

The particular features and advantages of the embodiment(s) as well as other objects will become apparent from the following description taken in connection with the accompanying drawings, in which:

FIG. 3 is a table illustrating correspondences between specified errors and error messages to be displayed;

FIG. 5 is a flowchart illustrating a drum memory check process executed by the controller in the image forming apparatus according to the embodiment;

DETAILED DESCRIPTION

Hereinafter, one embodiment of the present disclosure will be described in detail with reference to the accompanying drawings.

Figure 1:
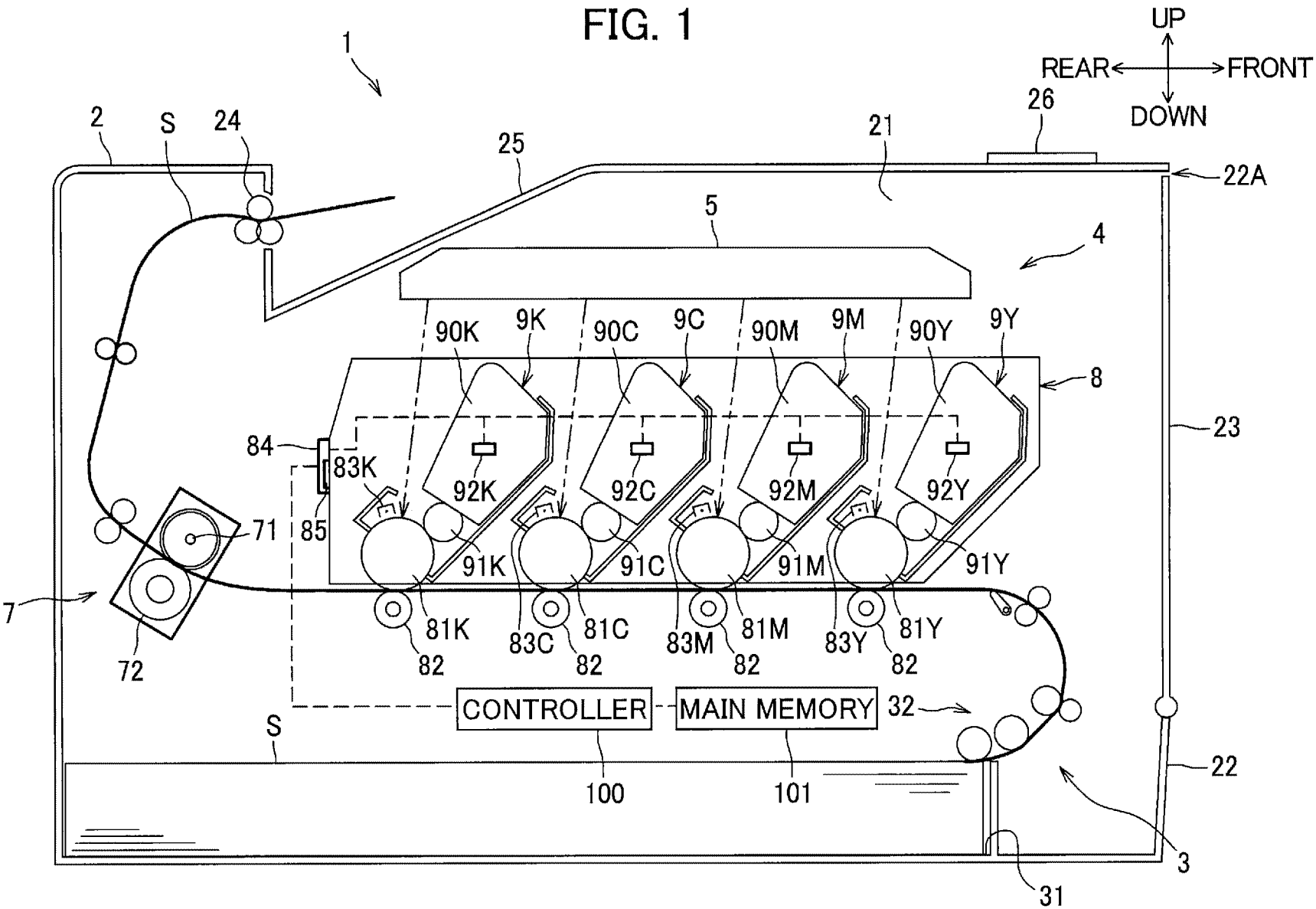
FIG. 1 is a cross-sectional view schematically illustrating an image forming apparatus according to one embodiment of the present disclosure.

An image forming apparatus 1 illustrated in FIG. 1 is a color laser printer. The image forming apparatus 1 includes a main casing 2, a feeding unit 3, an image forming unit 4, a controller 100, a main memory 101, and a display 26. The feeding unit 3 is configured to feed a sheet(s) S toward an internal space of the main casing 2. The image forming unit 4 is configured to form an image on the sheet S.

The main casing 2 is in a form of a hollow case. The main casing 2 has a pair of side walls 21, and a front wall 22 connecting the side walls 21 to each other. The front wall 22 has a main opening 22A. The front wall 22 includes a front cover 23 that is pivotally movable to open and close the main opening 22A.

The feeding unit 3 includes a feed tray 31 and a feed mechanism 32. The feed tray 31 is attachable to and detachable from a lower portion of the main casing 2. The feed mechanism 32 is configured to feed the sheet S in the feed tray 31 toward the image forming unit 4.

The image forming unit 4 includes a scanner unit 5, a fixing unit 7, a drum cartridge 8, and transfer rollers 82.

The scanner unit 5 is positioned at an upper portion inside the main casing 2 and includes a laser emitting unit, a polygon mirror, lenses, and a reflecting mirror those are not illustrated. The scanner unit 5 is configured to irradiate surfaces of photosensitive drums 81 (described later) with laser beam by high-speed scanning.

The controller 100 includes, for example, a CPU, a RAM, a ROM, and an input/output circuit. The controller is configured to perform arithmetic processing based on information about toner cartridges 9 attached to the main casing 2, programs and data those stored in the ROM to execute printing control.

The display 26 is positioned at an outer surface of the main casing 2, and is configured to display thereon various messages based on instructions outputted from the controller 100.

The drum cartridge 8 is positioned between the feeding unit 3 and the scanner unit 5. The drum cartridge 8 is attachable to and detachable from the main casing 2 through the main opening 22A opened and closed by the front cover 23 of the main casing 2.

The drum cartridge 8 is configured to receive the toner cartridges 9. In the present embodiment, four toner cartridges 9Y, 9M, 9C, and 9K containing four colors of toner of yellow, magenta, cyan, and black, respectively, are arranged in this order from the upstream side to the downstream side in a conveying direction of the sheet S. Throughout the specification and the drawings, the four colors are specified by adding "Y", "M", "C", and "K" to the reference numerals, such as the toner cartridges 9Y, 9M, 9C, and 9K.

The drum cartridge 8 includes four photosensitive drums 81Y, 81M, 81C, and 81K, four chargers 83Y, 83M, 83C, and 83K, and a substrate 84. The substrate 84 includes a drum memory 85.

Each of the chargers 83Y, 83M, 83C, and 83K is applied with voltage by an application circuit to generate corona discharge to charge the surface of the corresponding one of the photosensitive drums 81Y, 81M, 81C, and 81K.

The toner cartridges 9Y, 9M, 9C, and 9K include toner casings 90Y, 90M, 90C, and 90K, developing rollers 91Y, 91M, 91C, and 91K, and toner memories 92Y, 92M, 92C, and 92K, respectively.

Each of the toner casings 90Y, 90M, 90C, and 90K is configured to accommodate toner therein. Each of the developing rollers 91Y, 91M, 91C, and 91K is configured to supply toner to the corresponding one of the photosensitive drums 81Y, 81M, 81C, and 81K.

In the image forming apparatus 1, the surface of each rotating photosensitive drum 81 is uniformly charged by the corresponding charger 83 and is then exposed by high-speed scanning of laser beam emitted from the scanner unit 5. As a result, the potential of the exposed part of the surface is lowered and an electrostatic latent image based on image data is formed on the surface of the photosensitive drum 81.

Then, the toner in each toner cartridge 9 is supplied to the electrostatic latent image on the corresponding photosensitive drum 81 by the rotating developing roller 91 to form a toner image on the surface of the photosensitive drum 81. Thereafter, a sheet S is conveyed to a portion between each photosensitive drum 81 and the corresponding transfer roller 82, whereby the toner image retained on the surface of each photosensitive drum 81 is transferred onto the sheet S.

The fixing unit 7 includes a heating roller 71 and a pressure roller 72. The pressure roller 72 is positioned to face the heating roller 71 and presses the heating roller 71. The fixing unit 7 thermally fixes the toner transferred onto the sheet S while the sheet S passes through a portion between the heating roller 71 and the pressure roller 72.

The sheet S onto which the toner image is thermally fixed by the fixing unit 7 is conveyed to a discharge roller 24 positioned at a downstream side of the fixing unit 7 and fed onto a discharge tray 25 by the discharge roller 24.

When the toner cartridges 9Y, 9M, 9C, and 9K are attached to the drum cartridge 8, the substrate 84 and the toner memories 92Y, 92M, 92C, and 92K are electrically connected to each other. Also, when the drum cartridge 8 is attached to the main casing 2, the controller 100 and the substrate 84 are electrically connected to each other.

Figure 2:
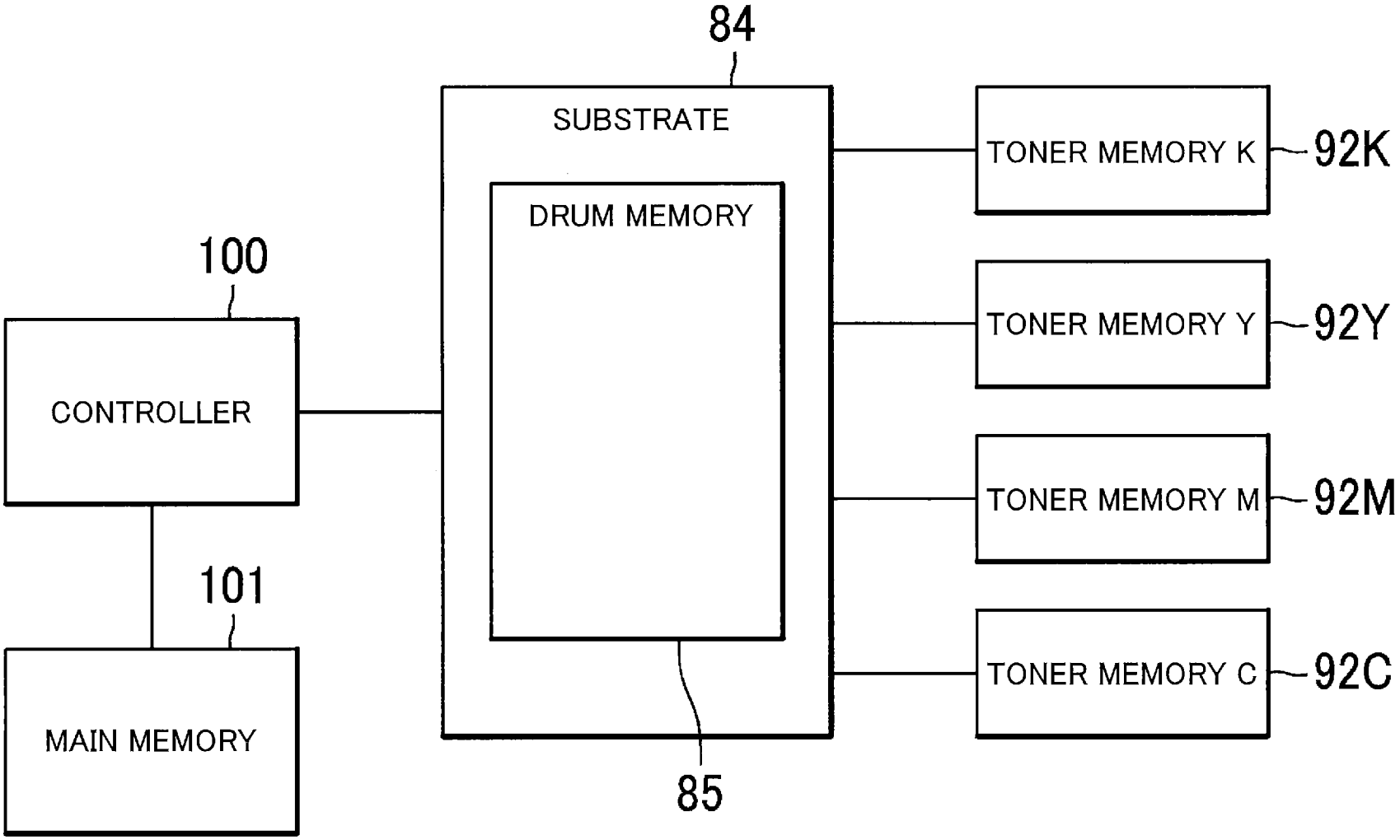
FIG. 2 is a block diagram illustrating an electrical connection among a controller, a drum memory, and toner memories in the image forming apparatus according to the embodiment.

With these electrical connections, as illustrated in FIG. 2, the controller 100 can communicate with the drum memory 85 through the substrate 84 when the drum cartridge 8 is attached to the main casing 2. Further, when the toner cartridges 9Y, 9M, 9C, and 9K are attached to the drum cartridge 8 and the drum cartridge 8 is attached to the main casing 2, the controller 100 can communicate with the toner memories 92Y, 92M, 92C, and 92K through the drum cartridge 8.

The main memory 101 stores therein data relating to a type of the image forming apparatus 1.

The drum memory 85 is a medium that stores information therein. For example, the drum memory 85 is an IC chip, but need not be limited to an IC chip. The drum memory 85 has a storage element storing therein data relating to a type of the drum cartridge 8.

Each of the toner memories 92Y, 92M, 92C, and 92K is a medium that stores information therein. Each of the toner memories 92Y, 92M, 92C, and 92K is an IC chip, for example, but need not be limited to an IC chip. Each of the toner memories 92Y, 92M, 92C, and 92K has a storage element that stores therein data for a type of the toner cartridge 9.

The controller 100 can determine, through a communication with the drum memory 85, whether an error occurs in the drum cartridge 8. As illustrated in FIG. 3, in the present embodiment, the controller 100 can determine whether any of three types of errors, i.e., a communication error, an authentication error, and a data error occurs in the drum cartridge 8.

The controller 100 attempts to communicate with the drum memory 85. When the controller 100 cannot communicate with the drum memory 85, the controller 100 determines that the communication error indicating that the communication with the drum memory 85 is not established occurs in the drum cartridge 8. For example, the communication error occurs when the drum cartridge 8 is not properly attached to the main casing 2. When determining that the communication error occurs in the drum cartridge 8, the controller 100 does not permit the image forming unit 4 to perform an image formation.

The controller 100 attempts to authenticate the drum memory 85. When the controller cannot authenticate the drum memory 85, the controller 100 determines that an authentication error indicating that an authentication of the drum cartridge 8 is not successful occurs. For example, the authentication error occurs when the controller 100 cannot recognize the attached drum cartridge 8 as a drum cartridge suitable for an image formation (for example, when the attached drum cartridge 8 is not a component compatible to the image forming apparatus 1). When determining that the authentication error occurs in the drum cartridge 8, the controller 100 does not permit the image forming unit 4 to perform an image formation.

When the controller 100 reads data stored in the drum memory 85 and determines that the type of the drum cartridge 8 identified based on the read data does not match the type the drum cartridge 8 stored in the main memory 101, the controller 100 determines that a data error indicating that the type of the drum cartridge 8 does not match the type stored in the main memory 101 occurs. When determining that the data error occurs in the drum cartridge 8, the controller 100 does not permit the image forming unit 4 to perform an image formation.

A case where the type of the drum cartridge 8 does not match the type of the drum cartridge 8 stored in the main memory 101 includes, for example, a case where destination data of the drum cartridge 8 acquired from the drum memory 85 and destination data of the image forming apparatus 1 stored in the main memory 101 do not match each other. The destination data refers to a product delivery destination and is generally classified according to regions, jobs, or categories, for example.

The case where the type of the drum cartridge 8 does not match the type of the drum cartridge 8 stored in the main memory 101 further includes, for example, a case where data acquired from the drum memory 85 indicating whether the drum cartridge 8 is a normal version or a special version, and data stored in the main memory 101 indicating whether the image forming apparatus 1 is a compatible to a drum cartridge 8 of the normal version or a drum cartridge 8 of the special version, do not match each other.

The controller 100 can determine, through a communication with the toner memories 92, whether an error(s) occurs in the toner cartridges 9. Note that the controller 100 communicates with each of the toner memories 92Y, 92M, 92C, and 92K. The controller 100 can determine whether any of three types of errors, i.e., a communication error, an authentication error, and a data error occurs in each of the toner cartridges 9.

The controller 100 attempts to communicate with the toner memory 92. When the controller 100 cannot communicate with the toner memory 92, the controller 100 determines that a communication error indicating that the communication with the toner memory 92 is not established occurs in the toner cartridge 9. For example, the communication error occurs when the toner cartridge 9 is not properly attached to the drum cartridge 8. When determining that the communication error occurs in the toner cartridge 9, the controller 100 does not permit the image forming unit 4 to perform an image formation.

The controller 100 attempts to authenticate the toner memory 92, and when the controller 100 cannot authenticate the toner memory 92, the controller 100 determines that an authentication error indicating that the toner cartridge 9 cannot be authenticated occurs. For example, the authentication error occurs when the controller 100 cannot recognize the attached toner cartridge 9 as a toner cartridge suitable for an image formation in the image forming apparatus 1 (for example, when the attached toner cartridge 9 is not a toner cartridge compatible to the image forming apparatus 1). When determining that the authentication error occurs in the toner cartridge 9, the controller 100 does not permit the image forming unit 4 to perform an image formation.

When the controller 100 reads data stored in the toner memory 92 and determines that the type of the toner cartridge 9 identified based on the read data does not match the type of the toner cartridge 9 stored in the main memory 101, the controller 100 determines that a data error indicating that the type of the toner cartridge 9 does not match the type of the toner cartridge 9 stored in the main memory 101 occurs. When determining that the data error occurs in the toner cartridge 9, the controller 100 does not permit the image forming unit 4 to perform an image formation.

A case where the type of the toner cartridge 9 does not match the type of the toner cartridge 9 stored in the main memory 101 includes, for example, a case where destination data of the toner cartridge 9 acquired from the toner memory 92 and destination data of the image forming apparatus 1 stored in the main memory 101 do not match each other.

The case where the type of the toner cartridge 9 does not match the type of the toner cartridge 9 stored in the main memory 101 further includes, for example, a case where data acquired from the toner memory 92 indicating whether the toner cartridge 9 is a normal version or a special version, and data stored in the main memory 101 indicating whether the image forming apparatus 1 is compatible to a toner cartridge 9 of the normal version or a toner cartridge 9 of the special version, do not match each other.

When determining that an error occurs in the drum cartridge 8 and that an error occurs in the toner cartridge 9, the controller 100 displays on the display 26 an error relating to the drum cartridge 8 in preference to an error relating to the toner cartridge 9.

In order to display on the display 26 an error relating to the drum cartridge 8 in preference to an error relating to the toner cartridge 9, an error with a higher priority may be displayed at an upper part, and an error with a lower priority may be displayed at a lower part. Alternatively, an error with a lower priority may be displayed in parenthesis or in a small size. Still alternatively, an error with a lower priority may not be displayed. In the present embodiment, an error with a higher priority is displayed on the display 26, and an error with a lower priority (errors shown in parenthesis in the table of FIG. 3) can be viewed when a user scrolls a message on the display 26.

When the controller 100 cannot communicate with both of the drum memory 85 and the toner memory 92, the controller 100 displays on the display 26 an error "NO DRUM" indicating that the drum cartridge 8 is not attached in preference to an error indicating that the toner cartridge 9 is not attached. In this case, when a user scrolls an error on the display 26, an error "NO TONER" indicating that the toner cartridge 9 is not attached appears.

When the controller 100 can communicate with the toner memory 92 but cannot communicate with the drum memory 85, the controller 100 displays on the display 26 an error "DRUM SUBSTRATE ABNORMAL" indicating that the substrate 84 is abnormal in preference to an error relating to the toner cartridge 9.

When the controller 100 can communicate with the drum memory 85, the controller 100 attempts to authenticate the drum memory 85. When the controller 100 fails to authenticate the drum memory 85, the controller 100 displays on the display 26 an error "CANNOT DETECT DRUM" indicating that the drum cartridge 8 cannot be detected in preference to an error relating to the toner cartridge 9.

When the controller 100 succeeds in authenticating the drum memory 85, the controller 100 reads data stored in the drum memory 85 from the drum memory 85, and determines whether the type of the drum cartridge 8 indicated by the data read from the drum memory 85 matches the type of the drum cartridge 8 indicated by data stored in the main memory 101. When determining that the type of the drum cartridge 8 indicated by the read data does not match the type indicated by data stored in the main memory 101, the controller 100 displays on the display 26 an error "DRUM ERROR" indicative of an error relating to the type of the drum cartridge 8 in preference to an error relating to the toner cartridge 9.

When the controller 100 attempts to communicate with the toner memory 92 under a condition where no error occurs in the drum cartridge 8 and fails to communicate with the toner memory 92, the controller 100 displays on the display 26 an error "NO TONER" indicating that the toner cartridge 9 is not attached.

When the controller 100 can communicate with the toner memory 92 under the condition where no error occurs in the drum cartridge 8, the controller 100 attempts to authenticate the toner memory 92. When the controller 100 fails to authenticate the toner memory 92, the controller 100 displays on the display 26 an error "CANNOT DETECT TONER" indicating that an authentication of the toner cartridge 9 is unsuccessful.

When the controller 100 succeeds in authenticating the toner memory 92 under the condition where no error occurs in the drum cartridge 8, the controller 100 reads data stored in the toner memory 92 and determines whether the type of the toner cartridge 9 indicated by the read data matches the type of the toner cartridge 9 stored in the main memory 101. When determining that the type of the toner cartridge 9 indicated by the read data does not match of the type of the toner cartridge 9 stored in the main memory 101, the controller 100 displays on the display 26 an error "TONER ERROR" which is an error relating to the type of the toner cartridge 9.

When the controller 100 acquires information which is not an error but information for which an alert is necessary, the controller 100 notifies a user of the information after determining whether an error occurs in the drum cartridge 8 and whether an error occurs in the toner cartridge 9. In this case, the controller 100 may allow an image formation performed by the image forming unit 4.

The controller 100 determines whether manufacturer data of the drum cartridge 8 acquired from the drum memory 85 and manufacturer data of the image forming apparatus 1 stored in the main memory 101 matches each other. When determining that the manufacturer data of the drum cartridge 8 and the manufacturer data of the image forming apparatus 1 do not match each other, the controller 100 displays on the display 26 an alert indicating that the drum cartridge 8 is a non-genuine product.

The controller 100 determines whether the manufacturer data of the toner cartridge 9 acquired from the toner memory 92 and the manufacturer data of the image forming apparatus 1 stored in the main memory 101 agree with each other. When determining that the manufacturer data of the toner cartridge 9 and the manufacturer data of the image forming apparatus 1 do not agree with each other, the controller 100 displays, on the display 26, a warning message indicating that the toner cartridge 9 is a nongenuine product.

The controller 100 communicates with the toner memory 92 and determines whether color data (YMCK) of the toner cartridge 9 acquired from the toner memory 92 corresponds to the color (YMCK) of a position to which the toner cartridge 9 is attached. When the controller 100 determines that the color data of the toner cartridge 9 does not correspond to the color of a position to which the toner cartridge 9 is attached, the controller 100 displays on the display 26 an alert indicating that the color of the attached toner cartridge 9 is not appropriate.

Next, one example of a process executed by the controller 100 will be described with reference to flowcharts of FIGS. 4 to 7.

Figure 4:
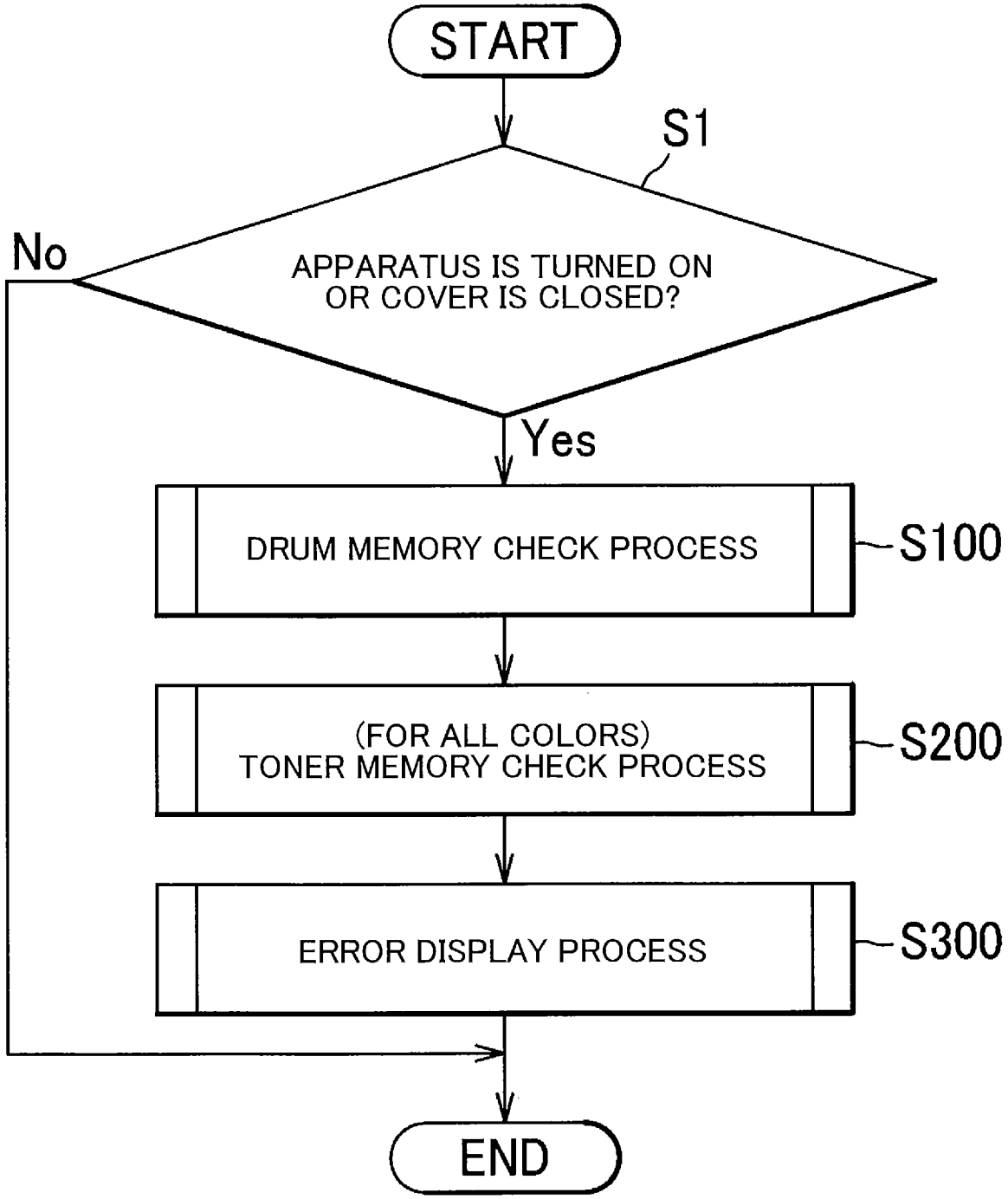
FIG. 4 is a flowchart illustrating one example of a process executed by the controller in the image forming apparatus according to the embodiment.

As illustrated in FIG. 4, when the controller 100 determines that the image forming apparatus 1 is turned ON or that the front cover 23 is closed (S1: YES), the controller 100 executes a drum memory check process in S100, a toner memory check process in S200, and an error display process in S300. Note that, when the drum cartridge 8 and toner cartridge 9 are provided in plural numbers, the controller 100 executes the respective drum memory check process and the toner memory check process for all colors.

When the controller 100 does not determine that the image forming apparatus 1 is turned ON or the front cover 23 is closed (S1: NO), the controller 100 ends the process in FIG. 4 without executing the drum memory check process, the toner memory check process, and the error display process.

The drum memory check process will next be described with reference to a flowchart of FIG. 5.

As illustrated in FIG. 5, in S101 the controller 100 determines whether the controller 100 can communicate with the drum memory 85. When the controller 100 determines that a communication with the drum memory 85 is not established (S101: NO), in S102 the controller 100 determines that a drum memory communication error occurs in the drum cartridge 8.

When the controller 100 determines in S101 that the communication with the drum memory 85 is established (S101: YES), in S103 the controller 100 attempts to authenticate the drum memory 85 and determines whether an authentication of the drum memory 85 is successful. When the controller 100 determines in S103 that the authentication of the drum memory 85 is not successful (S103: NO), in S104 the controller 100 determines that a drum memory authentication error occurs in the drum cartridge 8.

When the controller 100 determines in S103 that the authentication of the drum memory 85 is successful (S103: YES), in S105 the controller 100 reads drum memory data from the drum memory 85, and in S106 the controller 100 determines whether the drum memory data can be read from the drum memory 85. When the controller 100 determines in S106 that the drum memory data cannot be read from the drum memory 85 (S106: NO), in S104 the controller 100 determines that a drum memory authentication error occurs in the drum cartridge 8.

When the controller 100 determines in S106 that the drum memory data can be read successfully (S106: YES), in S107 the controller 100 determines whether the type of the drum cartridge 8 matches between two data. That is, the controller 100 determines whether the type of the drum cartridge 8 indicated by the drum memory data acquired from the drum memory 85 in S105 matches the type of the drum cartridge 8 indicated by data stored in the main memory 101. When the controller 100 determines in S107 that the type of the drum cartridge 8 does not match (S107: NO), in S108 the controller 100 determines that a drum memory data error occurs in the drum cartridge 8.

When the controller 100 determines in S107 that the type of the drum cartridge 8 matches (S107: YES), in S109 the controller 100 determines whether the data of the drum memory 85 falls within a range of a normal value. The range of the normal value is prestored in the main memory 101. When the controller 100 determines in S109 that the data of the drum memory 85 does not fall within the range of the normal value (S109: NO), in S108 the controller 100 determines that a drum memory data error occurs in the drum cartridge 8.

When the controller 100 determines in S109 that the data of the drum memory 85 falls within the range of the normal value (S109: YES), in S110 the controller 100 determines whether the drum cartridge 8 is a genuine product. When the controller 100 determines in S110 that the drum cartridge 8 is not a genuine product (S110: NO), in S111 the controller 100 displays on the display 26 an alert indicating that the attached drum cartridge 8 is a non-genuine product.

When the controller 100 determines in S110 that the drum cartridge 8 is a genuine product (S110: YES), the controller 100 ends the drum memory check process.

Next, the toner memory check process will be described with reference to a flowchart illustrated in FIG. 6.

Figure 6:
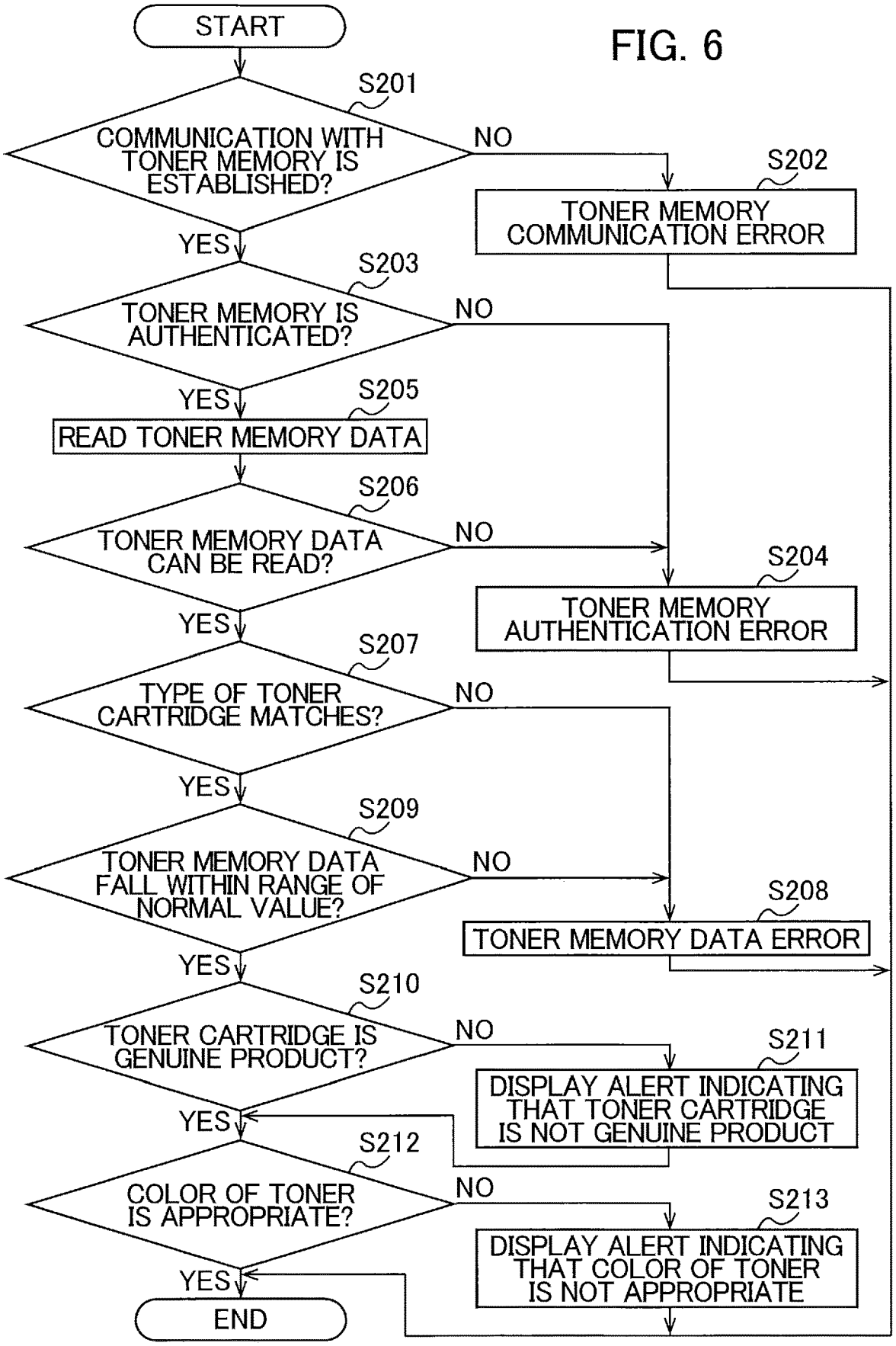
FIG. 6 is a flowchart illustrating a toner memory check process executed by the controller in the image forming apparatus according to the embodiment.

As illustrated in FIG. 6, in S201 the controller 100 determines whether a communication with the toner memory 92 is established. When the controller 100 determines that the communication with the toner memory 92 is not established (S201: NO), in S202 the controller 100 determines that a toner memory communication error occurs in the toner cartridge 9.

When the controller 100 determines in S201 that the communication with the toner memory 92 is established (S201: YES), in S203 the controller 100 attempts to authenticate the toner memory 92 and determines whether the authentication of the toner memory 92 is successful. When the controller 100 determines in S203 that the authentication of the toner memory 92 is not successful (S203: NO), in S204 the controller 100 determines that toner memory authentication error occurs in the toner cartridge 9.

When the controller 100 determines in S203 that the toner memory 92 can be authenticated (S203: YES), the controller 100 reads in S205 toner memory data from the toner memory 92, and in S206 determines whether the toner memory data can been read from the toner memory 92. When the controller 100 determines in S206 that the toner memory data cannot be read from the toner memory 92 (S206: NO), in S204 the controller 100 determines that a toner memory authentication error occurs in the toner cartridge 9.

When the controller 100 determines in S206 that the toner memory data can be read from the toner memory 92 succeeded (S206: YES), in S207 the controller 100 determines whether the type of the toner cartridge 9 matches. Specifically, the controller 100 determines whether the type of the toner cartridge 9 indicated by the toner memory data read from the toner memory 92 in S205 matches the type of the toner cartridge 9 indicated by data stored in the main memory 101. When the controller 100 determines in S207 that the type of the toner cartridge 9 does not match (S207: NO), in S208 the controller 100 determines that a toner memory data error occurs in the toner cartridge 9.

When the controller 100 determines in S207 that the type of the toner cartridge 9 matches (S207: YES), in S209 the controller 100 determines whether the toner memory data acquired from the toner memory 92 falls within a range of a normal value. When the controller 100 determines in S209 that the data of the toner memory 92 does not falls within the range of the normal value (S209: NO), in S208 the controller 100 determines that a toner memory data error occurs in the toner cartridge 9.

When the controller 100 determines in S209 that the data of the toner memory 92 falls within the range of the normal value range (S209: YES), in S210 the controller 100 determines whether the toner cartridge 9 is a genuine product. When the controller 100 determines in S210 that the toner cartridge 9 is not a genuine product (S210: NO), in S211 the controller 100 displays on the display 26 an alert indicating that the attached toner cartridge 9 is a non-genuine product.

In both cases where the controller 100 determines in S210 that the toner cartridge 9 is a genuine product (S210: YES) and where the controller 100 determines in S210 that the toner cartridge 9 is not a genuine product (S210: NO), in S212 the controller 100 determines whether the toner cartridge 9 is attached to a position corresponding to a color of the toner cartridge 9. When determining in S212 that the toner cartridge 9 is not attached to a position corresponding thereto, in S213 the controller 100 displays on the display 26 an alert indicating that the toner cartridge 9 is attached to an inappropriate color position.

When the controller 100 determines in S212 that the toner cartridge 9 is attached to its corresponding color position (S212: YES), the controller 100 ends the toner memory check process.

Next, the error display process will be described with reference to a flowchart of FIG. 7.

Figure 7:
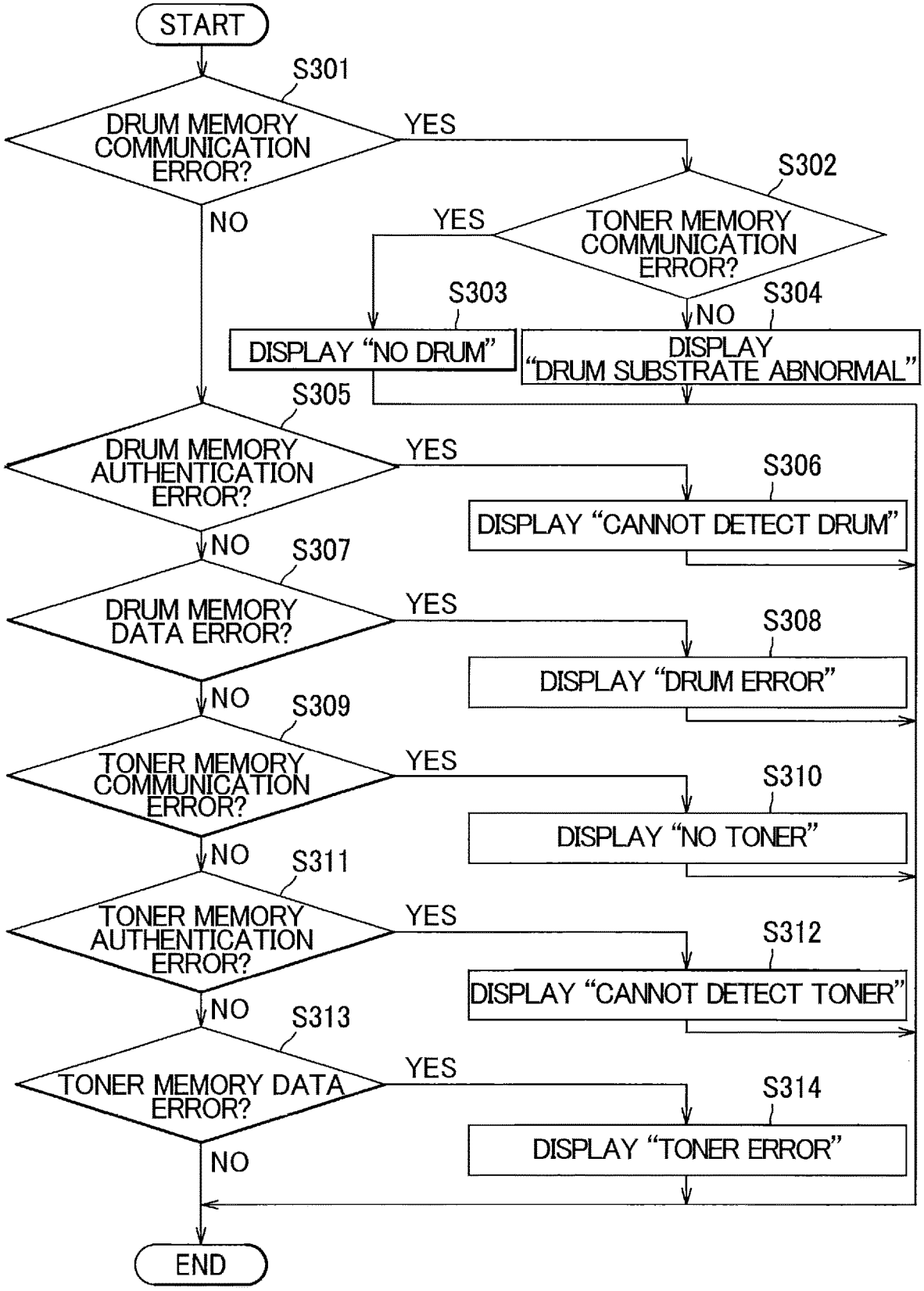
FIG. 7 is a flowchart illustrating an error display process executed by the controller in the image forming apparatus according to the embodiment.

As illustrated in FIG. 7, in S301 the controller 100 determines whether the drum memory communication error occurs in the drum cartridge 8.

When the controller 100 determines in S301 that the drum memory communication error occurs in the drum cartridge 8 (S301: YES), in S302 the controller 100 determines whether the toner memory communication error occurs in the toner cartridge 9.

When the controller 100 determines in S302 that the toner memory communication error occurs in the toner cartridge 9 (S302: YES), in S303 the controller 100 displays an error massage "NO DRUM" on the display 26. On the other hand, when the controller 100 determines in S302 that the toner memory communication error does not occur (S302: NO), in S304 the controller 100 displays an error massage "DRUM SUBSTRATE ABNORMAL" on the display 26.

On the other hand, when the controller 100 determines in S301 that the drum memory communication error does not occur (S301: NO), in S305 the controller 100 determines whether a drum memory authentication error occurs in the drum cartridge 8. When the controller 100 determines in S305 that the drum memory authentication error occurs (S305: YES), in S306 the controller 100 displays an error message "CANNOT DETECT DRUM" on the display 26.

When the controller 100 determines in S305 that the drum memory authentication error does not occur (S305: NO), in S307 the controller 100 determines whether a drum memory data error occurs in the drum cartridge 8. When the controller 100 determines in S307 that the drum memory data error occurs (S307: YES), in S108 the controller 100 displays an error message "DRUM ERROR" on the display 26.

When the controller 100 determines in S307 that the drum memory data error does not occur (S307: NO), in S309 the controller 100 determines whether a toner memory communication error occurs in the toner cartridge 9. When the controller 100 determines in S309 that the toner memory communication error occurs (S309: YES), in S310 the controller 100 displays an error message "NO TONER" on the display 26.

When the controller 100 determines in S309 that the toner memory communication error (S309: NO), in S311 the controller 100 determines whether a toner memory authentication error occurs in the toner cartridge 9. When the controller 100 determines in S311 that the toner memory authentication error occurs (S311: YES), in S312 the controller 100 displays an error message "CANNOT DETECT TONER" on the display 26.

When the controller 100 determines in S311 that the toner memory authentication error (S311: NO), in S313 the controller 100 determines whether a toner memory data error occurs in the toner cartridge 9. When the controller 100 determines in S313 that whether the toner memory data error occurs (S313: YES), in S314 the controller 100 displays an error message "TONER ERROR" on the display 26.

When the controller 100 determines that none of the above errors occurs, the controller 100 does not display any error on the display 26 and ends the error display process in FIG. 7.

As described above, the image forming apparatus 1 according to the present embodiment exhibits the following technical advantages.

In conventional image forming apparatuses, when an error relating to an attachment of the drum cartridge and an error relating to an attachment of the toner cartridge, which one of the two errors is preferentially displayed is not considered. Thus, assuming a case where an error relating to the toner cartridge is displayed ahead of an error relating to the drum cartridge, the following inconvenience may arise: a user replaces the current toner cartridge with a new toner cartridge in accordance with a display of the error relating to the toner cartridge, and there is still a display of the errors relating to the drum cartridge which will cause the user to remove the new toner cartridge from the drum cartridge for replacement of the drum cartridge.

However, with the controller 100 of the image forming apparatus 1 according to the present embodiment, when it is determined that an error occurs in the drum cartridge 8 and that an error occurs in the toner cartridge 9, the controller 100 displays on the display 26 the error relating to the drum cartridge 8 in preference to any error occurred in the toner cartridge 9. Through this operation, of two errors relating to the drum cartridge 8 and the toner cartridge 9, an error relating to the drum cartridge 8 can be displayed in preference to an error relating to the toner cartridge 9, thereby enabling the user to properly deal with displayed errors.

Further, the controller 100 can communicate with the drum memory 85 through the substrate 84 and can communicate with the toner memories 92 through the substrate 84. Thus, the controller 100 can read information stored in the drum memory 85 and toner memories 92 just by communicating with the substrate 84, whereby the number of components in the image forming apparatus 1 can be reduced.

Further, the controller 100 attempts to communicate with both the drum memory 85 and each toner memory 92. When the controller 100 cannot communicate with the drum memory 85 but can communicate with the toner memory 92, the controller 100 displays on the display 26 an error indicating that the substrate 84 is abnormal in preference to any error occurred in the toner cartridge 9. Accordingly, a user can be notified of abnormality in the substrate 84 of the drum cartridge 8 can be preferentially.

Further, when the controller 100 attempts to and cannot communicate with both the drum memory 85 and the toner memory 92, the controller 100 displays on the display 26 an error indicating that the drum cartridge 8 is not attached in preference to an error indicating that the toner cartridge 9 is not attached. Thus, the controller 100 can preferentially notify a user of the error indicating that the drum cartridge 8 is not attached.

Further, when the controller 100 can communicate with the drum memory 85, the controller 100 attempts to authenticate the drum memory 85. When the controller 100 cannot authenticate the drum memory 85, the controller 100 displays on the display 26 an error indicating that the drum cartridge 8 cannot be recognized in preference to any error occurred in the toner cartridge 9. Thus, the controller 100 can preferentially notify a user of the error indicating that the drum cartridge 8 cannot be recognized.

Further, when the controller 100 can authenticate the drum memory 85 successfully, the controller 100 reads data stored in the drum memory 85 from the drum memory 85 and determines whether the type of the drum cartridge 8 indicated by data stored in the drum memory 85 matches the type of the drum cartridge 8 indicated by data stored in the main memory 101. When the controller 100 determines that the type of the drum cartridge 8 does not match of the type indicated by data stored in the main memory 101, the controller 100 displays on the display 26 an error relating to the type of the drum cartridge 8 in preference to any error in the toner cartridge 9. Thus, the controller 100 can preferentially notify a user of the error relating to the type of the drum cartridge 8.

While the description has been made in detail with reference to the embodiment, it would be apparent to those skilled in the art that the present disclosure is not limited to the above embodiment and various modifications made thereto, as described below.

Figure 8:
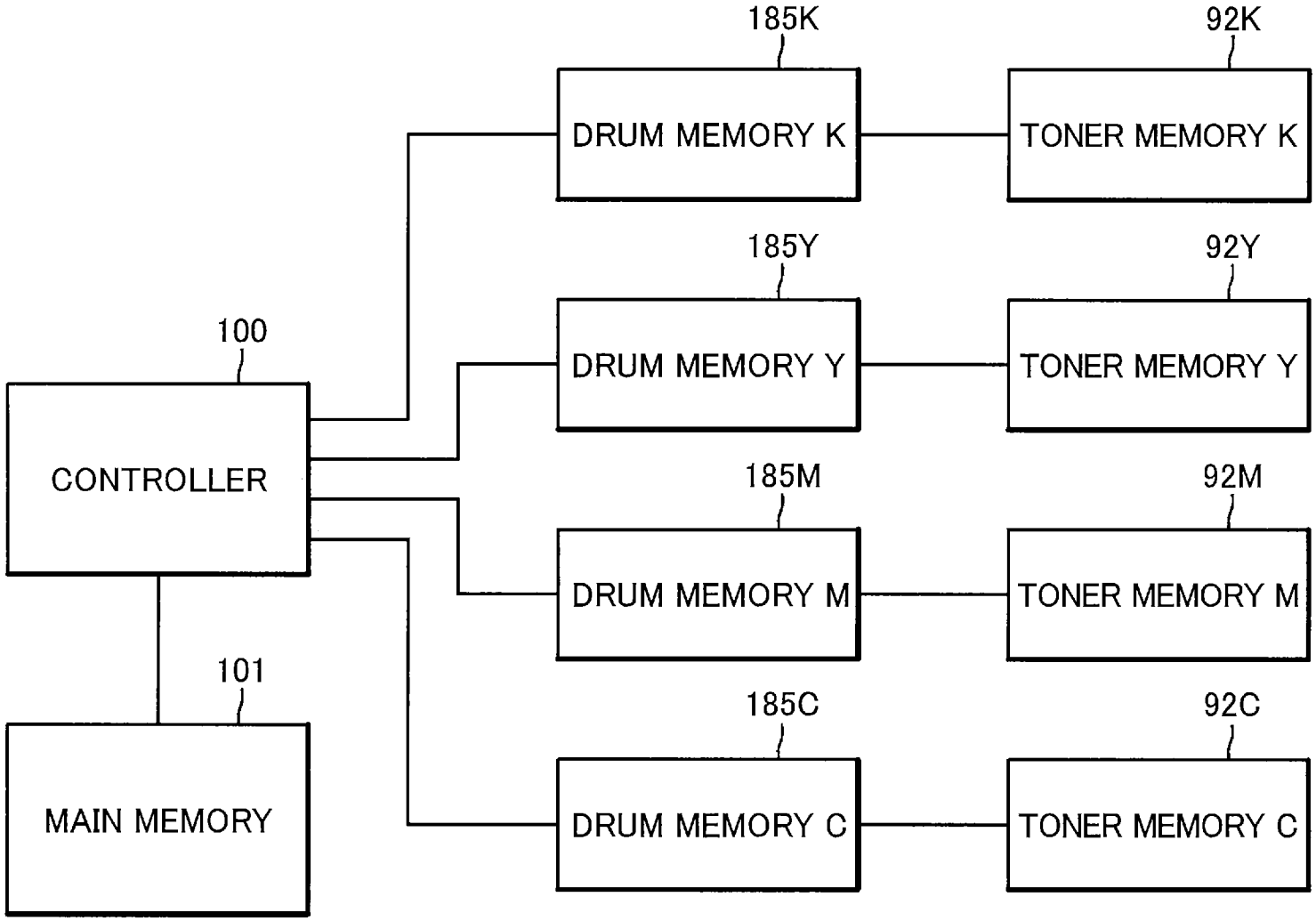
FIG. 8 is a block diagram corresponding to FIG. 2 in an image forming apparatus according to a modification to the embodiment.

In the above-described embodiment, the controller 100 can communicate with the toner memories 92 of the toner cartridges 9 through the substrate 84 of the drum cartridge 8 (see FIG. 2). However, the above configuration may not be employed, and the controller 100 may communicate with the toner memories 92 not through the substrate 84. For example, in a modification illustrated in FIG. 8, the image forming apparatus 1 includes four drum memories 185K, 185Y, 185M, and 185C provided corresponding to the toner memories 92K, 92Y, 92M, and 92C, respectively. In this modification, the controller 100 communicates with the toner memories 92 of respective colors through the drum memories 185 corresponding to the respective colors.

In the above embodiment, a color laser printer is employed as one example of the image forming apparatus 1. However, the image forming apparatus may be a monochrome laser printer, a copying machine, or a multifunction peripheral.

Although error messages are displayed on the display 26 in the above-described embodiment, the error messages may be displayed on other components such as a personal computer connected to the image forming apparatus. Alternatively, a notification of errors to a user may be performed in other ways such as voice or sound.

In the above-described embodiment, the toner cartridge 9 includes a developing roller 91. However, the toner cartridge need not include a developing roller. In this case, a developing roller may be provided in the drum cartridge.

Each element appearing in the above-described embodiment and modifications may be suitably combined for implementation.

What is claimed is:

1. An image forming apparatus comprising:

a main casing;

a drum cartridge attachable to and detachable from the main casing, the drum cartridge including a photosensitive drum and a drum memory;

a toner cartridge attachable to and detachable from the drum cartridge, the toner cartridge including a toner memory; and a controller, wherein the controller is configured to:

determine whether an error occurs in the drum cartridge through a communication with the drum memory;

determine whether an error occurs in the toner cartridge through a communication with the toner memory; and when determining that an error occurs in the drum cartridge and determining that an error occurs in the toner cartridge, notify an error relating to the drum cartridge in preference to notifying an error relating to the toner cartridge.

2. The image forming apparatus according to claim 1, wherein the controller is configured to communicate with the toner memory through the drum cartridge when the toner cartridge is attached to the drum cartridge.

3. The image forming apparatus according to claim 2, wherein the drum cartridge further includes a substrate, and wherein the controller is configured to communicate with the toner memory through the substrate.

4. The image forming apparatus according to claim 3, wherein the substrate includes the drum memory, and wherein the controller is configured to communicate with the drum memory through the substrate.

5. The image forming apparatus according to claim 4, wherein the controller is configured to:

attempt to communicate with both of the drum memory and the toner memory; and when failing to communicate with the drum memory and succeeding in communicating with the toner memory, notify an error indicating that the substrate is abnormal in preference to notifying an error relating to the toner cartridge.

6. The image forming apparatus according to claim 1, wherein the controller is configured to:

attempt to communicate with both of the drum memory and the toner memory; and when failing to communicate with both of the drum memory and the toner memory, notify an error indicating that the drum cartridge is not attached in preference to notifying an error indicating that the toner cartridge is not attached.

7. The image forming apparatus according to claim 6, wherein the controller is configured to:

when succeeding in communicating with the drum memory, attempt to authenticate the drum memory; and when failing to authenticate the drum memory, notify an error indicating that the drum cartridge cannot be recognized in preference to notifying an error relating to the toner cartridge.

8. The image forming apparatus according to claim 7, further comprising a main memory, wherein the controller is configured to:

when succeeding in authenticating the drum memory, read data stored in the drum memory from the drum memory;

determine whether a type of the drum cartridge indicated by the read data matches a type of the drum cartridge indicated by data stored in the main memory; and when determining that the type of the drum cartridge indicated by the data does not match the type of the drum cartridge indicated by the data stored in the main memory, notify an error relating to the type of the drum cartridge in preference to notifying an error relating to the toner cartridge.

9. The image forming apparatus according to claim 1, wherein the toner cartridge further includes a developing roller.

10. The image forming apparatus according to claim 1, wherein the controller is configured to determine whether an error occurs in the toner cartridge even in a case where the controller determines that an error occurs in the drum cartridge.

11. The image forming apparatus according to claim 1, further comprising a display, wherein the controller is configured to, when determining that an error occurs in the drum cartridge and determining that an error occurs in the toner cartridge, display on the display the error relating to the drum cartridge in preference to displaying on the display the error relating to the toner cartridge.

* * * * *